United States Patent [19]

Ruggiero

[11] 4,027,866

[45] June 7, 1977

[54] MULTI-FACE CLAMP FOR MANUFACTURING OR REGLUING OF DRAWERS, CHAIRS OR THE LIKE

[76] Inventor: Arthur Ruggiero, 68 Soundview St., New Rochelle, N.Y. 10805

[22] Filed: Dec. 29, 1975

[21] Appl. No.: 644,627

[52] U.S. Cl. ..... 269/41; 269/121; 269/242; 269/243; 269/274

[51] Int. Cl.[2] ..... B25B 1/20

[58] Field of Search ..... 269/40, 41, 111, 121, 269/242, 243, 274

[56] References Cited

UNITED STATES PATENTS

| | | | |
|---|---|---|---|
| 1,528,105 | 3/1925 | Froelich et al. | 269/242 |
| 2,753,902 | 7/1956 | Klee | 269/243 |
| 2,796,787 | 6/1957 | Aske | 269/274 |

*Primary Examiner*—Al Lawrence Smith
*Assistant Examiner*—Robert C. Watson
*Attorney, Agent, or Firm*—Ernest G. Montague

[57] ABSTRACT

A multi-face clamp for wood working which comprises a clamping unit including a plurality of corner pieces. Each of the corner pieces defines at least two pressure faces which are adapted to engage complementary faces of a work piece. Two threaded bolts extend from and are operatively connected with the corner pieces. One of the threaded bolts has threads formed in an opposite direction from those of the other of the threaded bolts. A turn-buckle is disposed between each pair of adjacent corner pieces and receives in its inner threads the respective free end portions of the threaded bolts, so that upon turning of the turn-buckle the pressure faces of the corner piece exert pressure upon the complementary faces of the work piece.

2 Claims, 5 Drawing Figures

MULTI-FACE CLAMP FOR MANUFACTURING OR REGLUING OF DRAWERS, CHAIRS OR THE LIKE

The present invention relates to a multi-face clamp for manufacturing or regluing of drawers, chairs, frames of cabinets, or the like.

It is known that drawers of similar structure are joined by providing dowels extending from one part of the drawer structure into another part thereof and which dowels are received in complementary slots of the other part to be glued together with the first mentioned part. At the present time, individual clamps are used for gluing together complementary parts of adjacent plates of a drawer, in order to provide the connection between each pair of engaging plates. Such joining of complementary plates with a conventional clamp requires an individual clamping of each pair of adjacent plates.

The present invention is designed to provide a clamp-like unit disposed along each plate of the drawer or the like in order to glue together simultaneously all four plates forming the drawer.

It is, therefore, one object of the present invention to provide a clamp-like unit which permits gluing together three or more parts of a chair, drawer or the like which task is performed at the same time.

It is another object of the present invention to provide corner pieces which engage the complementary parts of the chair or the like which corner pieces are connected by threaded bolts having right and left hand threads, respectively, to be received by a turn-buckle and in addition are connected with the corner pieces by means of a swivel joint and the threaded bolts being disposed along the individual plates of the structure forming the chair, the drawer, or the like, thereby permitting the manufacturing or regluing of a great variety of structures.

It is still another object of the present invention to provide a clamp unit which operates as a labor saving device in view of the fact that it permits gluing together at the same time of three or more plates of the article to be produced and exerting pressure between the corner pieces of the clamp unit and the plates of the article.

With these and other objects in view, which will become apparent in the following detailed description, the present invention, which is shown by example only, will be clearly understood in connection with the accompanying drawings, in which.

Figure 1:
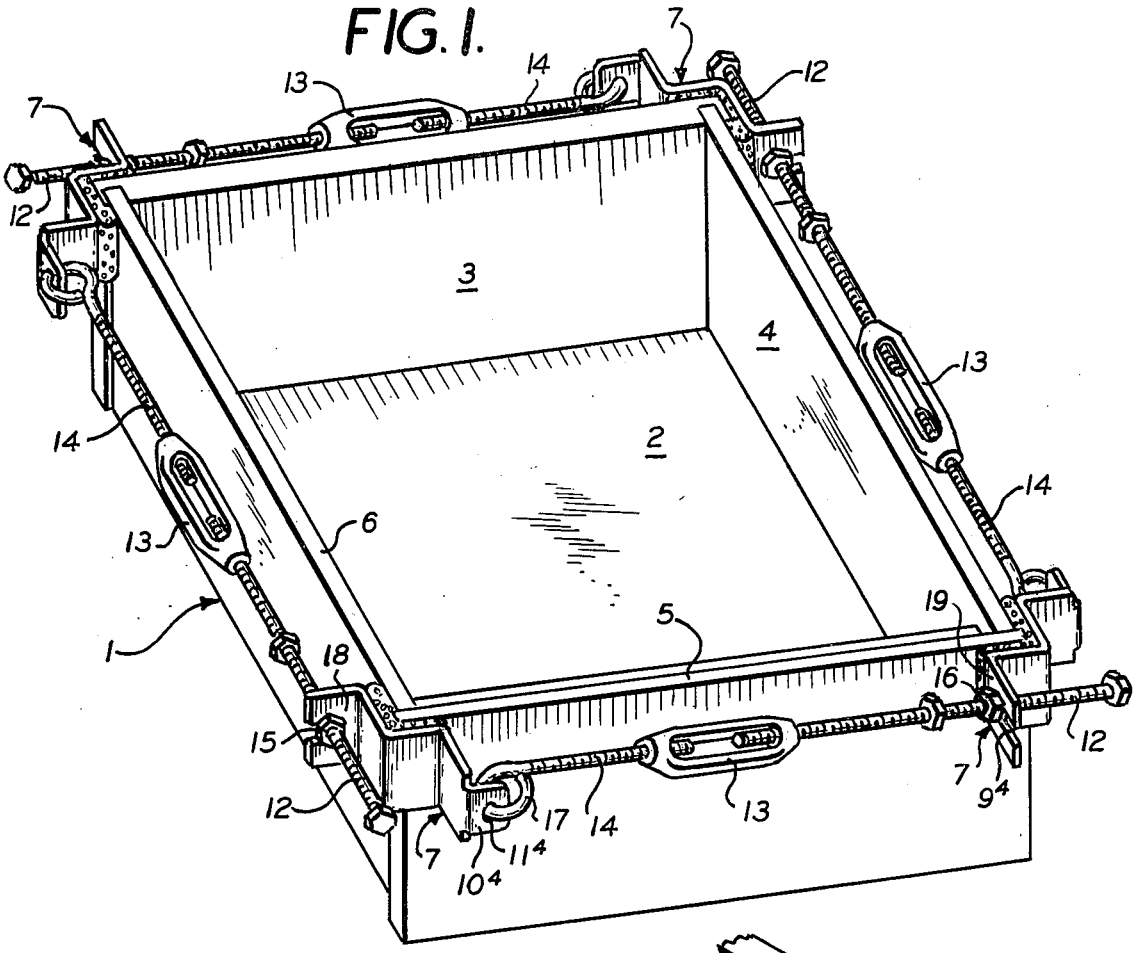
FIG. 1 is a perspective top view of a drawer surrounded by four clamp units.
Figure 2:
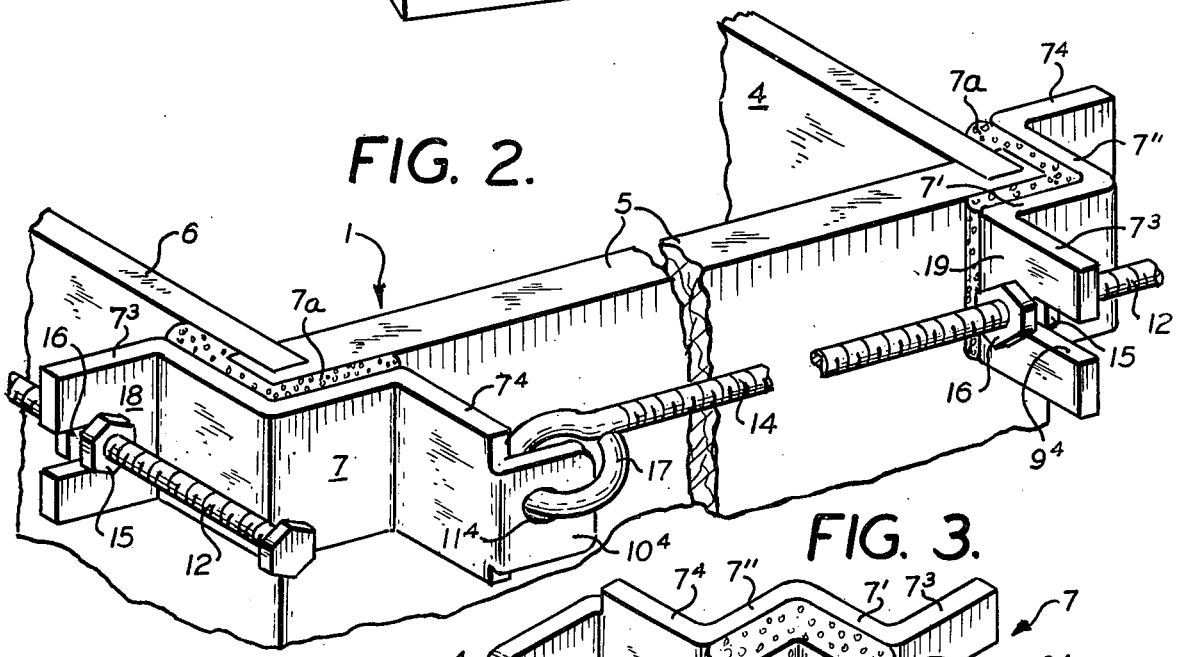
FIG. 2 is an enlarged perspective view disclosing two corner pieces engaging the complementary portions of the drawer.
Figure 3:
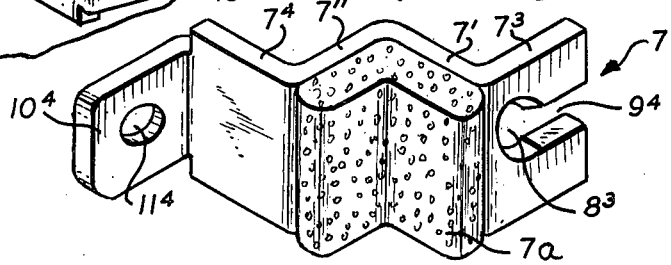
FIG. 3 is a perspective view of a corner piece disclosing and ear extending therefrom and indicating rubber-lined surfaces of the corner piece.

Referring now to the drawings, and in particular to FIGS. 1–3, the clamping unit designed in accordance with the present invention is shown in connection with a drawer 1 consisting of a bottom plate 2 and four vertical side plates 3, 4, 5 and 6. A W-shaped corner member 7 is provided at each corner of the drawer 1, which corner member 7 is preferably made of flat sheet metal and then bent to form the W-shape. The two center portions of the corner member 7, namely the portions 7′ and 7″ form a substantially right angle and are adapted to engage the rectangular corner faces of the drawer 1. In order to reduce any possibility of relative movement between the corner members 7 and the corner faces of the drawer 1, the portions 7′ and 7″ are equipped with a rubber layer 7*a*. This arrangement is also necessary to avoid the slipping off of the clamp. End portions $7^3$ and $7^4$ extend from the center portions 7′ and 7″, respectively, at an angle of substantially 90° to form together with the center portions 7′ and 7″ the W-shape of the corner members 7. The end portion $7^3$ is equipped with a bore $8^3$ which leads into a channel $9^4$. The other end portion $7^4$ has a flange-like extension $10^4$ which forms a right angle with the end portion $7^4$ and forms a bore or eye $11^4$ therein.

A first threaded bolt 12 is inserted through the channel $9^4$ into the bore $8^3$ of the end portion $7^3$ and extends along one of the vertical plates of the drawer 1 into a turn-buckle 13. A second threaded bolt 14 forms a hook 17 at one end which is inserted into the bore or eye $11^4$, thereby forming a swivel joint between the threaded bolt 14 and the corresponding corner member 7. The threads of the threaded bolt 12 are formed in an opposite direction from those of the threaded bolt 14 for the right and left hand screw connection. The ends of the respective threaded bolts 12 and 14 enter corresponding inner thread portions of the turn-buckle 13, so that upon turning the turn-buckle 13 the corner members 7 are pressed against the engaging corner faces of the drawer 1 and correspondingly exert pressure to tighten together the respective corners of the drawer 1.

Upon applying the same arrangement to each pair of adjacent plates of the drawer 1 and upon turning the respective turn-buckles 13 disposed along each of the vertical walls 3, 4, 5 and 6 of the drawer 1, the manufacture or regluing of the drawer 1 can be brought about.

As clearly shown in FIG. 2 of the drawings, a nut 15 is mounted on the threaded bolt 12 in such manner that it engages the outer face 18 of the end portion $7^3$ of the corner member 7, thereby pushing the corner member 7 towards the corresponding outer engaging corner face of the drawer 1. As can be seen likewise from FIG. 2 of the drawings, a second nut 16 is mounted on the threaded bolt 12, which nut 16 engages the opposite face 19 of the end portion $7^3$.

In order to permit the use of the clamp unit for drawers or chairs of different sizes, the threaded bolt 12 is of greater length and has threaded thereon a plurality of nuts axially spaced apart from each other, so that the clamp unit is capable of being used for different sizes of drawers or chairs. It is to be understood that only some of those additional nuts lend themselves for being mounted on the threaded bolt 12, while others are locally secured to the given position on the threaded bolt 12. This arrangement is particularly indicated in the embodiment clearly shown in FIG. 5 of the drawings.

In order to put the clamp unit in operative position, at first each of the four corner members 7 is connected with the respective threaded bolts 12 and 14 by threading the inner ends of the latter into the turn-buckles 13. In this position it is possible to slide the entire clamp unit consisting of the four corner members 7 and the respective threaded bolts 12 and 13 loosely onto the side plates 3, 4, 5 and 6, whereupon successively the four turn-buckles 13 are turned and thereby pressure is exerted between the corner members 7 and the complementary plates of the drawer or the like. In this position the previously applied glue is permitted to dry with the dowels in joint position and upon hardening of the glue, by turning the turn-buckles in opposite direction, the corner members 7 can be returned into their original loose position.

Figure 4:
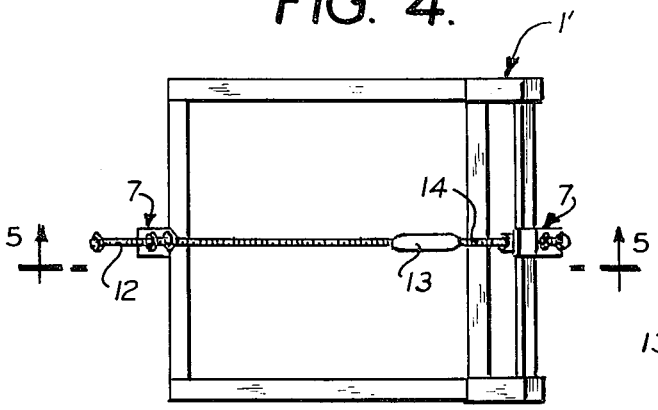
FIG. 4 is a top plan view of a clamped chair.
Figure 5:
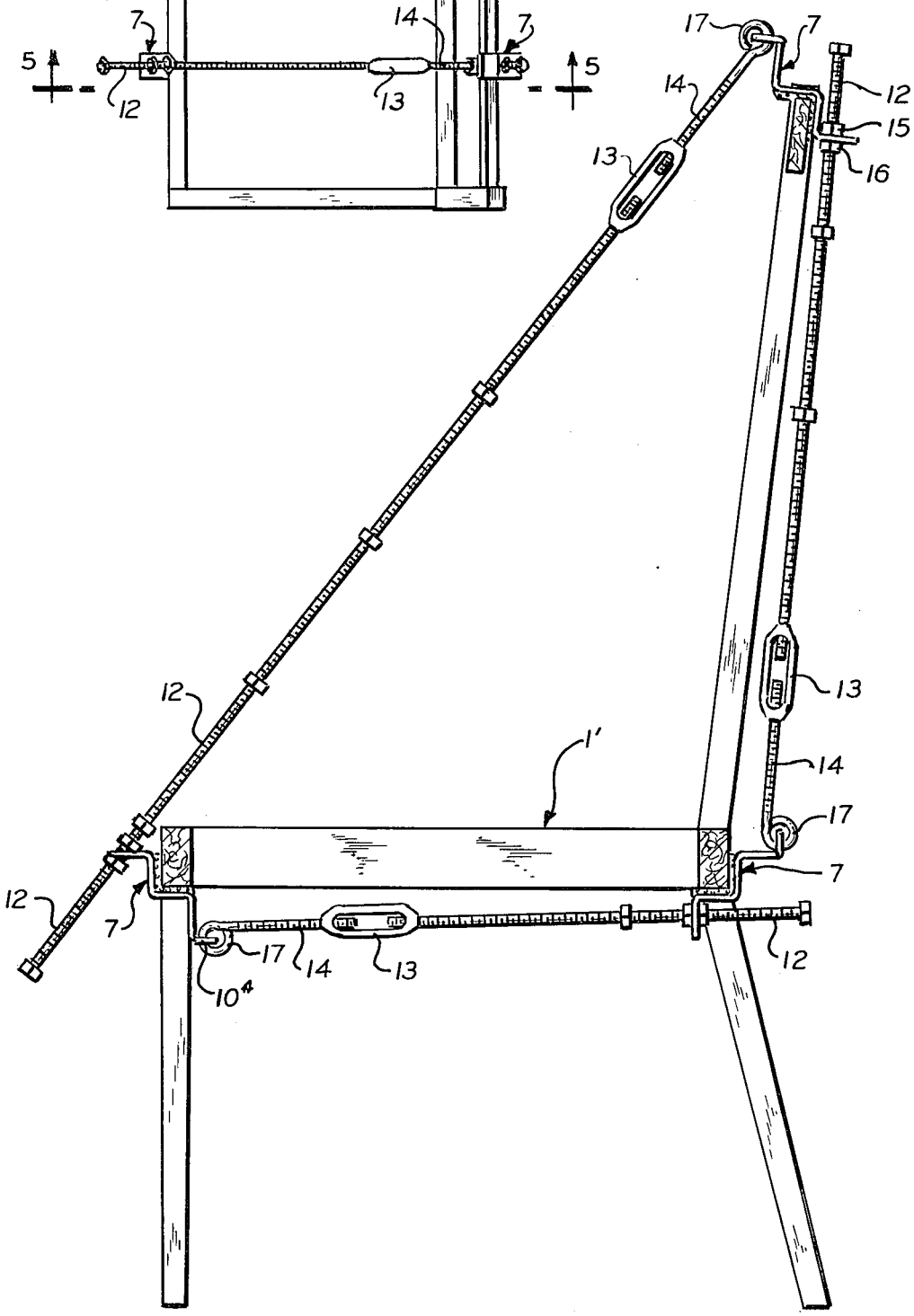
FIG. 5 is a vertical section along the lines 5—5 of FIG. 4, showing a complete clamping.

Referring now again to the drawings, and in particular to FIGS. 4 and 5, the clamp unit is disclosed in connection with the manufacture or regluing of the seat and the back of a chair 1' requiring a three-part clamp unit. This application shows clearly also the requirement of the provision of a swivel joint between one corner member 7 and one of the threaded bolts 12 and 14, respectively. Each individual clamp unit comprises again a corner member 7 engaging the chair frame and each clamp unit includes threaded bolts 12 and 14 having right and left hand threads which are received by complementary threads (not shown) of a turn-buckle 13. In order to arrive at the tensioning position of the turn-buckle 13, it is merely necessary to subject the turn-buckle to a slight turning, which operation brings about a narrowing of the two threaded bolts 12 and 14 towards each other and thereby an exertion of pressure by the corner member 7 of the clamp unit upon corresponding outer faces of the drawer, chair or the like.

While I have disclosed two embodiments of the present invention, it is to be understood that these embodiments are given by example only and not in a limiting sense.

I claim:

1. A multi-face clamp for woodworking comprising a clamping unit including a plurality of corner pieces, each of said corner pieces defining at least two pressure faces adapted to engage complementary faces of a work piece, two threaded bolts extending from and operatively connected with said corner pieces, one of said threaded bolts having threads formed in an opposite direction from those of the other of said threaded bolts, a turn-buckle disposed between each pair of adjacent corner pieces and receiving in its inner threads the respective free end portions of said threaded bolts, so that upon turning of said turn-buckle the pressure faces of said corner piece exert pressure upon said complementary faces of said work piece, wherein at least one of said threaded bolts has a plurality of nuts, some of said nuts being adjustable along said of one said threaded bolts, and means on said corner piece for retaining said one of said threaded bolts selectively in a plurality of end positions.

2. The multi-face clamp, as set forth in claim 1, wherein said corner pieces comprise a plate bent to form a right angle therebetween and defining said pressure faces, an end portion extending from each end of said plate and bent to form a right angle relative to the adjacent portion of said plate, one of said end portions having an eye leading into an open channel, in order to permit insertion of one of said threaded bolts, and the other of said end portions extending into a flange having an eye receiving the other of said threaded bolts by means of a hook to form a swivel joint therebetween.

* * * * *